US009377720B2

(12) United States Patent
Lior et al.

(10) Patent No.: US 9,377,720 B2
(45) Date of Patent: Jun. 28, 2016

(54) APPARATUS FOR ELECTROPHOTOGRAPHIC PRINTING INCLUDING A WETTING DEVICE AND METHOD FOR USING THE SAME

(71) Applicant: HEWLETT-PACKARD DEVELOPMENT COMPANY, L.P., Houston, TX (US)

(72) Inventors: Shai Lior, Nes Ziona (IL); Mark Sandler, Ness Ziona (IL); Peter Nedelin, Ness Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/761,755

(22) PCT Filed: Jan. 29, 2013

(86) PCT No.: PCT/EP2013/051699

§ 371 (c)(1),
(2) Date: Jul. 17, 2015

(87) PCT Pub. No.: WO2014/117819

PCT Pub. Date: Aug. 7, 2014

(65) Prior Publication Data

US 2015/0323889 A1 Nov. 12, 2015

(51) Int. Cl.

| | |
|---|---|
| ***G03G 15/16*** | (2006.01) |
| ***G03G 15/01*** | (2006.01) |
| ***G03G 15/10*** | (2006.01) |

(52) U.S. Cl.

CPC ..... *G03G 15/162* (2013.01); *G03G 15/0189* (2013.01); *G03G 15/10* (2013.01); *G03G 15/1695* (2013.01)

(58) Field of Classification Search

CPC ..... G03G 15/101; G03G 15/1695

See application file for complete search history.

(56) References Cited

U.S. PATENT DOCUMENTS

| | | | | |
|---|---|---|---|---|
| 7,400,850 | B2 | 7/2008 | Romem | |
| 7,517,622 | B2 | 4/2009 | Golodetz | |
| 7,856,927 | B2 | 12/2010 | Peleg | |
| 2007/0059618 | A1* | 3/2007 | Kurimoto | G03G 5/047 430/58.5 |
| 2008/0252680 | A1 | 10/2008 | Schmid et al. | |

(Continued)

FOREIGN PATENT DOCUMENTS

| | | |
|---|---|---|
| JP | 2000066531 | 3/2000 |
| JP | 2002258542 | 9/2002 |
| JP | 2005195636 | 7/2005 |

(Continued)

OTHER PUBLICATIONS

Hast, J, "Printing Techniques" Nov. 15, 2011.

*Primary Examiner* — Rodney Bonnette
(74) *Attorney, Agent, or Firm* — HP Inc. Patent Department

(57) ABSTRACT

Disclosed herein is a method for electrophotographic printing, the method comprising:

transferring, separately, from a photo imaging plate, a plurality of images formed from different colored electrostatic ink compositions to an intermediate transfer member to form a print image on the intermediate transfer member;

providing a print substrate that has been wetted with a protic solvent;

transferring the print image to the print substrate. Also disclosed herein is an apparatus for electrophotographic printing.

16 Claims, 4 Drawing Sheets

(56) References Cited

U.S. PATENT DOCUMENTS

2010/0230038 A1* 9/2010 Gila ..... G03G 9/13
156/231
2015/0268589 A1* 9/2015 Nedelin ..... G03G 15/101
101/216

FOREIGN PATENT DOCUMENTS

JP 2007121808 5/2007
JP 2011175209 9/2011
JP 2012126067 A 7/2012

* cited by examiner

APPARATUS FOR ELECTROPHOTOGRAPHIC PRINTING INCLUDING A WETTING DEVICE AND METHOD FOR USING THE SAME

BACKGROUND

Electrophotographic printing processes typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is sometimes termed a photo imaging plate (PIP). The photoconductive surface is selectively charged with a latent electrostatic image having image and background areas with different potentials. For example, an electrostatic ink composition comprising charged toner particles in a carrier liquid can be brought into contact with the selectively charged photoconductive substrate (e.g. paper) directly or, more commonly, by being first transferred to an surface. The charged toner particles adhere to the image areas of the latent image while the background areas remain clean. The image is then transferred to a print intermediate transfer member, which can be a soft swelling blanket, and then to the print substrate.

Two methods can be used when multi-color images are to be printed. Both involve the generation of multiple separations (i.e., single color partial images) that, when superimposed, result in the desired print image. Each of the images is separately generated on the photoconductive surface, transferred to the intermediate transfer member and then to the final substrate. In some systems, the images are separately transferred from the intermediate transfer member to the final substrate. In these systems, the images on the intermediate transfer member are each transferred in turn to, and are superimposed, in registration, on the final substrate; such systems are sometimes termed multi-shot systems. In other systems, referred to herein as one-shot systems, the images are separately formed on the photoconductive surface and are transferred in turn to the intermediate transfer member in registration and superposition thereon, to form a print image. The superimposed images in the form of a print image are then transferred together to the print substrate.

In some one-shot systems, the same photoconductive surface is used to generate the separations sequentially. In other systems a plurality of photoconductive surfaces are present, each of which generates an image of a different color, the plurality of images being superimposed on the intermediate transfer member.

DETAILED DESCRIPTION

Figure 1:
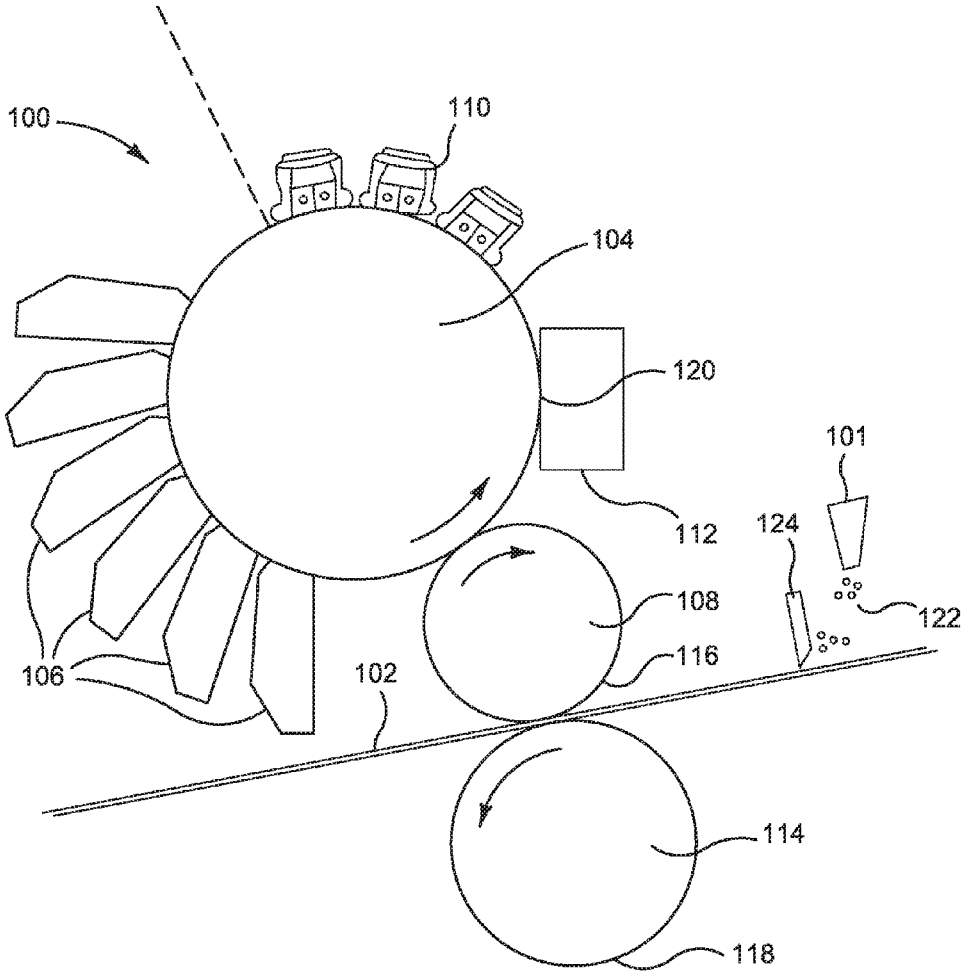
FIG. 1 shows schematically an example of an apparatus for carrying out an example of the method described herein.

Before the methods, apparatus and related aspects are disclosed and described, it is to be understood that this disclosure is not limited to the particular process steps and materials disclosed herein because such process steps and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier liquid," "carrier," or "carrier vehicle" refers to the fluid in which the polymers, particles, colorant, charge directors and other additives can be dispersed to form a liquid electrostatic ink or electrophotographic ink. The carrier liquids may include a mixture of a variety of different agents, such as surfactants, co-solvents, viscosity modifiers, and/or other possible ingredients.

As used herein, "electrostatic ink composition" generally refers to a ink composition, which may be in liquid form, that is typically suitable for use in an electrostatic printing process, sometimes termed an electrophotographic printing process. The electrostatic ink composition may comprise chargeable particles of a resin, which may be as described herein, dispersed in a carrier liquid, which may be as described herein.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not just pigment colorants, but other pigments such as organometallics, ferrites, ceramics, etc.

As used herein, "co-polymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

Described herein is a method for electrophotographic printing. The method may comprise transferring, separately, from a photo imaging plate, a plurality of images formed from different coloured electrostatic ink compositions to an intermediate transfer member to form a print image on the intermediate transfer member. The method may then further involve providing a print substrate that has been wetted with a protic solvent and then transferring the print image to the print substrate.

Also described herein is an apparatus for electrophotographic printing on a print substrate. The apparatus may comprise a photo imaging plate, an intermediate transfer member, and a wetting device for application of a protic solvent to the print substrate. The apparatus can, in some examples, form a plurality of images sequentially from different coloured electrostatic ink compositions on a photo imaging plate and transfer them separately from the photo imaging plate to the intermediate transfer member to form a print image on the intermediate transfer member and then transfer the print image to the print substrate. In some examples, the wetting device can apply the protic solvent to the print substrate before the print image is transferred to the print substrate.

The present inventors found that in some one-shot printing processes the adhesion of printed images to a print substrate was not as strong as may be desired. They found that the pre-wetting of a print substrate with a protic solvent increased adhesion of the inks to the print substrates. This allows non-primed print media to be printed using the one-shot method, and allows the one-shot printing processes to be used for sheet-fed printing systems, where priming can be complicated and expensive.

Each of the electrostatic ink compositions may comprise particles comprising a resin. In some examples, each of the ink compositions further comprises a liquid carrier, and the particles, which may comprise a resin, may be suspended in the liquid carrier. The ink compositions may further comprise a colorant. The particles, which may comprise the resin, may further comprise a colorant. In some examples, the ink compositions may substantially lack or lack a liquid carrier, and the particles may be in flowable form, for example so that they can be passed through the apparatus described herein. In some examples, the ink compositions may be in powder form.

The resin may include a thermoplastic polymer. In particular, the polymer of the resin may be selected from ethylene acrylic acid copolymers; ethylene methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl may include from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers; ethylene-acrylic esters-maleic anhydride (MAH) or glycidyl methacrylate (GMA) terpolymers; ethylene-acrylic acid ionomers and combinations thereof.

In some examples, the resin comprises a first polymer that is a copolymer of ethylene or propylene and an ethylenically unsaturated acid of either acrylic acid and methacrylic acid. In some examples, the first polymer is absent ester groups and the resin further comprises a second polymer having ester side groups, which may be a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

In step (a), the resin may constitute 5% to 99% by weight of the solids in the ink composition, in some examples 50% to 90% by weight of the solids of the ink composition, in some examples 70% to 90% by weight of the solids of the ink composition. The remaining wt % of the solids in the ink composition may be a colorant and, in some examples, any other additives that may be present.

The different colored electrostatic ink composition may comprise the same type of resin in that the type of the component parts of the resin and/or the amount by which the component parts of the resin are present relative to one another and/or any liquid carrier is the same in the different colored electrostatic ink compositions. In some examples the different colored electrostatic ink composition may comprise different types of resin in that the type of the component parts of the resin and/or the amount by which the component parts of the resin are present relative to one another and/or any liquid carrier is different in the different colored electrostatic ink compositions.

As mentioned herein, the ink composition may further comprise a liquid carrier, and the particles, which may comprise a resin, may be suspended in the liquid carrier. Generally, the liquid carrier acts as a dispersing medium for the other components in the electrostatic ink composition. For example, the liquid carrier can comprise or be a hydrocarbon, silicone oil, vegetable oil, etc. The liquid carrier can include, but is not limited to, an insulating, non-polar, non-aqueous liquid that is used as the medium for toner particles. The liquid carrier can include compounds that have a resistivity in excess of about $10^9$ ohm-cm. The liquid carrier may have a dielectric constant below about 30, in some examples below about 10, in some examples below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

In some examples, the liquid carrier constitutes about 20 to 99.5% by weight of the ink composition, in some examples 50 to 99.5% by weight of the ink compositions. In some examples, the liquid carrier, constitutes about 40 to 90% by weight of the ink composition. In some examples, the liquid carrier constitutes about 60 to 80% by weight of the ink compositions. In some examples, the liquid carrier may constitute about 90 to 99.5% of the electrostatic ink composition, in some examples 95 to 99% of the electrostatic ink compositions.

If present, the liquid carrier may be the same in the different colored electrostatic ink compositions, in that the type and/or the quantity of the liquid carrier in each different electrostatic ink composition is the same. In some examples, if present, the liquid carrier may be different in the different colored electrostatic ink compositions, in that the type and/or the quantity of the liquid carrier in each different electrostatic ink composition is different.

As mentioned herein, in some examples, each of the electrostatic ink compositions may further comprise a colorant. As mentioned herein, in some examples, the particles comprising the resin may further comprise a colorant. The colorant may be a dye or pigment. The colorant may be any colorant compatible with the liquid carrier, if present, and useful for electrostatic printing. For example, the colorant may be present as pigment particles. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

At least two different colored electrostatic ink compositions may be used in the method and/or apparatus. In some examples, at least three different colored electrostatic ink compositions may be used in the method and/or apparatus. In some examples, at least four different colored electrostatic ink compositions may be used in the method and/or apparatus. Different colored electrostatic ink compositions may indicate that a first electrostatic ink composition is a particular color from a selection of colors, and a second electrostatic ink composition is a color from the selection of colors other than the color of the first electrostatic ink composition. If a third electrostatic ink composition is used, it may have a color other than that of the first and second electrostatic ink compositions. Likewise, if a fourth or further colored electrostatic ink composition(s) is or are used, they may have a color different from each of the first, second, or third, and if more than four, the other colored electrostatic ink compositions. The selection of colors may comprise two or more of, in some examples three or more of, in some examples all of, cyan, magenta, yellow and black; in some examples, the selection of colors may further comprise a color selected from red, green and blue.

Each of the different electrostatic ink compositions may include a charge director. The charge director may be added to an electrostatic ink composition in order to impart and/or maintain sufficient electrostatic charge on the ink particles. In some examples, the charge director may comprise ionic compounds, particularly metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and nonionic compounds, such as polyoxyethylated alkylamines, lecithin, polyvinylpyrrolidone, organic acid esters of polyvalent alcohols, etc. In some examples, the charge director is selected from, but is not limited to, oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of a sulfonic acid. The sulfonic acids may include, but are not limited to, alkyl sulfonic acids, aryl sulfonic acids, and suffonic acids of alkyl succinates (e.g. see WO 2007/130069). In some examples, the charge director imparts a negative charge on the particles of the ink composition. In some examples, the charge director imparts a positive charge on the particles of the ink composition.

In some examples, the charge director comprises a sulfosuccinate moiety of the general formula $[R_{1'}—O—C(O)CH_2CH(SO_3^-)C(O)—O—R_{2'}]$, where each of $R_1'$ and $R_2'$ is an alkyl group. In some examples, the charge director comprises nanoparticles of a simple salt and a sulfosuccinate salt of the general formula MAn, wherein M is a metal, n is the valence of M, and A is an ion of the general formula ([$R_1$'—O—C(O)$CH_2$CH($SO_3^-$)C(O)—O—$R_{2'}$], where each of $R_{1'}$ and $R_{2'}$ is an alkyl group, or other charge directors as found in WO20071/30069, which is incorporation herein by reference in its entirety. As described in WO2007/130069, the sulfosuccinate salt of the general formula MAn is an example of a micelle forming salt. The charge director may be substantially free or free of an acid of the general formula HA, where A is as described above. The charge director may comprise micelles of said sulfosuccinate salt enclosing at least some of the nanoparticles. The charge director may comprise at least some nanoparticles having a size of 200 nm or less, and/or in some examples 2 nm or more. As described in WO2007/130069, simple salts are salts that do not form micelles by themselves, although they may form a core for micelles with a micelle forming salt. The ions constructing the simple salts are all hydrophilic. The simple salt may comprise a cation selected from the group consisting of Mg, Ca, Ba, NH4, tert-butyl ammonium, Li+, and Al+3, or from any sub-group thereof. The simple salt may comprise an anion selected from the group consisting of SO42-, PO3-, NO3-, HPO42-, CO32-, acetate, trifluoroacetate (TFA), Cl—, Bf, F—, ClO4-, and TiO34-, or from any sub-group thereof. The simple salt may be selected from CaCO3, Ba2TiO3, Al2(SO4), Al(NO3)3, Ca3(PO4)2, BaSO4, BaHPO4, Ba2(PO4)3, CaSO4, (NH4)2CO3, (NH4)2SO4, NH4OAc, Tert-butyl ammonium bromide, NH4NO3, LiTFA, A2(SO4)3, LiClO4 and LiBF4, or any sub-group thereof. The charge director may further comprise basic barium petronate (BBP).

In the formula [$R_{1'}$—O—C(O)$CH_2$CH($SO_3^-$)C(O)—O—$R_{2'}$], in some examples each of $R_{1'}$ and $R_{2'}$ is an aliphatic alkyl group. In some examples, each of $R_{1'}$ and $R_{2'}$ independently is a C6-25 alkyl. In some examples, said aliphatic alkyl group is linear. In some examples, said aliphatic alkyl group is branched. In some examples, said aliphatic alkyl group includes a linear chain of more than 6 carbon atoms. In some examples, $R_{1'}$ and $R_{2'}$ are the same. In some examples, at least one of $R_{1'}$ and $R_{2'}$ is C13H27. In some examples, M is Na, K, Cs, Ca, or Ba. The formula [$R_{1'}$—O—C(O)$CH_2$CH($SO_3^-$)C(O)—O—$R_{2'}$] and/or the formula MAn may be as defined in any part of WO2007/130069.

The charge director may comprise (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulfonate salt is dodecyl benzene sulfonic acid isopropyl amine, which is available from Croda.

In some examples, the charge director constitutes about 0.001% to 20%, in some examples 0.01 to 20% by weight, in some examples 0.01 to 10% by weight, in some examples 0.01 to 1% by weight of the solids of an electrostatic ink composition. In some examples, the charge director constitutes about 0.001 to 0.15% by weight of the solids of the electrostatic ink composition, in some examples 0.001 to 0.15%, in some examples 0.001 to 0.02% by weight of the solids of an electrostatic ink composition.

Each of the electrostatic ink compositions may comprise one or more additives, for example an additive selected from a charge adjuvant, a wax, a surfactant, biocides, organic solvents, viscosity modifiers, materials for pH adjustment, sequestering agents, preservatives, compatibility additives, emulsifiers and the like. In some examples each of the ink compositions comprises an aluminium salt, such as an aluminium salt of a fatty acid, including, but not limited to aluminium stearate. This acts to stabilise the charge on resin particles after being charged by passing between the first electrode and the developer roller. In some examples, aluminium salts, including aluminium stearate, act as charge adjuvants when a charge director is present.

The method may involve transferring, separately, from a photo imaging plate, a plurality of images formed from different colored electrostatic ink compositions to an intermediate transfer member to form a print image on the intermediate transfer member. The apparatus may be able to form a plurality of images sequentially from different coloured electrostatic ink compositions on a photo imaging plate and transfer them separately from the photo imaging plate to the intermediate transfer member to form a print image on the intermediate transfer member. The plurality of images may each be a separation, for example each formed from a different color, for example a color selected from magenta, cyan, yellow and black, and, in some examples a further color or further colors. The print image may be a composite image formed on the intermediate transfer member from the plurality of different colors of the electrostatic ink compositions. The plurality of images, which may be different color separations, may each be formed sequentially on the photo imaging plate. Each of the different color separation images on the photo imaging plate may have been formed by forming a latent electrostatic image on the photo imaging plate, and then transferring an electrostatic ink composition of a desired color to the photo imaging plate, so that the ink selectively binds to the latent electrostatic image on the photo imaging plate. The latent electrostatic image may have been formed by, for example, a laser directed at the surface of the photo imaging plate. The different electrostatic ink compositions may be transferred to the photo imaging plate from a plurality of different sources, for example reservoirs or containers of the ink compositions. In some examples, each of the different electrostatic ink compositions is transferred to a developer member, which may be in the form of a roller, from a source e.g. a container of the ink composition, and then transferred from the developer member to the photo imaging plate, which may be in contact with the developer member or sufficiently close to allow transfer of the ink composition from the surface of the developer member to the photo imaging plate. A potential may be applied between the various components to promote transfer of the electrostatic ink compositions from one component to another, for example from a source of electrostatic ink composition to a developer member and/or a developer member to a photo imaging plate, and/or from a photo imaging plate to an intermediate transfer member.

In some examples, the photo imaging plate is in the form of a cylinder that rotates on an axis. The photo imaging plate may comprise a photoreceptor material, for example a photoconductor comprising a compound of selenium.

Once the print image has been formed on the intermediate transfer member from the different colored electrostatic ink compositions, the print image is transferred to a print substrate.

The intermediate transfer member may be or comprise a rotating drum, which may have a compressible surface layer, which may be heated, e.g. to a temperature of from 80 to 160° C. in some examples from 90 to 130° C., in some examples from 100 to 110° C.

In some examples, the protic solvent is selected from water and an alcohol. In some examples, the protic solvent comprises water. The protic solvent may comprise, consist essentially of or consist of water. "Consist essentially of" indicates that the protic solvent may contain at least 95 wt/wt % water, in some examples at least 98 wt/wt % water, in some examples at least 99 wt/wt % water, in some examples at least 99.5 wt/wt % water, in some examples at least 99.9 wt/wt % water.

In some examples, the protic solvent comprises an alcohol, which may be an alkanol. The alkanol may be a C1 to C20 alkanol, in some examples a C1 to C10 alkanol, in some examples a C1 to C5 alkanol, in some examples an alkanol selected from methanol, ethanol, i- or n-propanol and t-, i- or n-butanol.

In some examples, the protic solvent is applied in an amount of from about 0.1 g to about 10 g of protic solvent per square meter of print substrate. In some examples, the protic solvent is applied in an amount of from about 0.1 g to about 5 g of protic solvent per square meter of print substrate, in some examples 0.1 about 0.1 g to about 2 g of protic solvent per square meter of print substrate, in some examples about 0.5 g to about 2 g of protic solvent per square meter of print substrate, in some examples about 0.5 g to about 1.5 g of protic solvent per square meter of print substrate. In some examples, the apparatus is configured to apply the protic solvent in an amount of from about 0.1 g to about 10 g of protic solvent per square meter of print substrate or in some examples in the other amounts mentioned above in relation to the method.

In some examples, the protic solvent is sprayed onto the print substrate and/or spread on a surface of the print substrate with a spreading member, to wet the print substrate with the protic solvent. The spreading member may be an elongate member that extends across at least some of the surface of the print substrate and is in contact therewith or sufficiently close to the surface, so that in the method or apparatus there is or can be relative movement of the spreading member across the surface to allow the water to be spread across the surface. The spreading member may be made of any suitable material, for example a rigid or flexible material. The spreading member may comprise, for example, a material selected from a metal, a plastic, a fabric and wood. In some examples the spreading member is a source of the protic solvent, and, for example has a plurality of holes therein to allow water to exit the spreading member and onto the print substrate.

In some examples, the protic solvent is applied to the print image in an even distribution across at least some of, in some examples the whole of, the area of the print substrate that is to receive the print image. In some examples, the protic solvent is applied across part of or the whole of the area of the print substrate. In some examples, the protic solvent is applied across part of or the whole of the width of the print substrate.

In some examples, the print substrate is in the form of sheet, and a plurality of separate sheets are printed using the method. In some examples, the apparatus can print a plurality print substrates in the form of separate sheets.

In some examples, the print substrate is in the form of a web and, in some examples, is fed from a roll of the print substrate. In some examples, the apparatus can print a print substrate in the form of a web, which may be fed to the intermediate transfer member from a roll.

In some examples, the protic solvent is applied in a printing apparatus that prints the print image onto the print substrate and the apparatus includes a wetting device that applies the protic solvent to the print substrate before the print image is transferred to the print substrate.

In some examples, the protic solvent is applied to the print substrate before it is passed into a printing apparatus that prints the print image on the print substrate.

In some examples, the wetting device is any device that facilitates the contact of a protic solvent, e.g. water, with the print substrate. The protic solvent, e.g. water, may be poured, sprayed, condensed on or otherwise contacted with the print substrate by the wetting device. In some examples, the wetting device of the apparatus can spray the protic solvent onto the print substrate and/or spread the protic solvent on a surface of the print substrate with a spreading member. The apparatus and/or the wetting device may be configured to control the placement and amount of protic solvent, e.g. water, applied per square meter of the print substrate.

The print substrate may be or comprise any suitable substrate. The print substrate may be any suitable substrate capable of having an image printed thereon. The print substrate may comprise a material selected from an organic or Inorganic material. The material may comprise a natural polymeric material, e.g. cellulose. The material may comprise a synthetic polymeric material. e.g. a polymer formed from alkylene monomers, including, but not limited to, polyethylene and polypropylene, and copolymers such as styrene-polybutadiene. The polypropylene may be biaxially orientated polypropylene. The material may comprise a metal, which may be in sheet form. The metal may be selected from or made from, for instance, aluminum (Al), silver (Ag), tin (Sn), copper (Cu), mixtures thereof. In some examples, the print substrate comprises a cellulosic paper. In some examples, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The print substrate may be a cellulosic print substrate such as paper. The cellulosic print substrate may be a coated cellulosic print substrate. e.g. having a coating of a polymeric material thereon.

Figure 2:
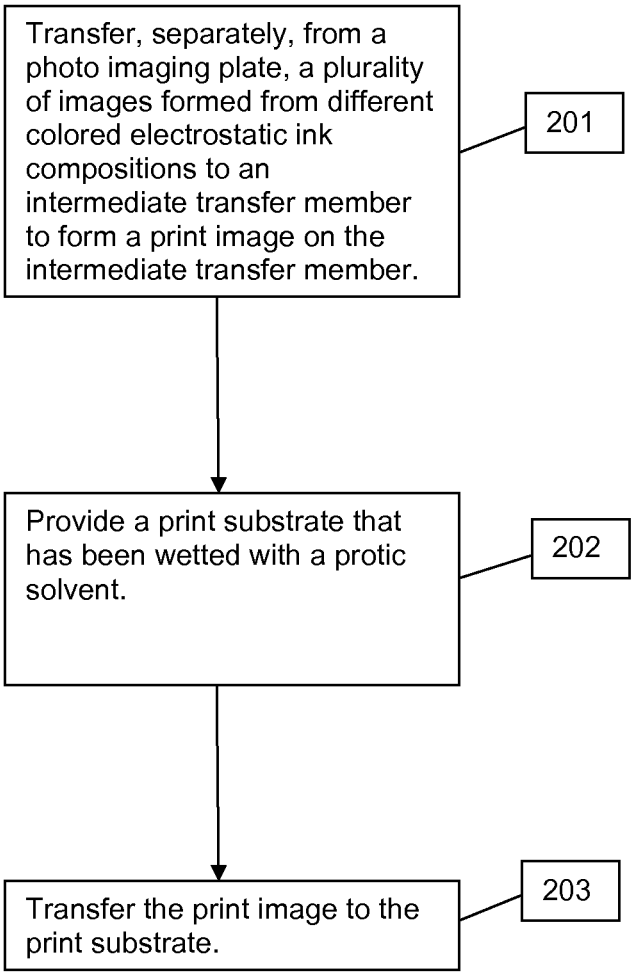
FIG. 2 shows a schematic illustration of an example of a method described herein.

A non-limiting example of the method described herein is shown in FIG. 2. Step 201 is to transfer, separately, from a photo imaging plate, a plurality of images formed from different colored electrostatic ink compositions to an intermediate transfer member to form a print image on the intermediate transfer member. Step 202 is to provide a print substrate that has been wetted with a protic solvent. Step 203 is to transfer the print image to the print substrate.

A non-limiting example of the method and apparatus as described herein will now be described with reference to FIG. 1.

FIG. 1 shows schematically an example of an apparatus 100 for carrying out an example of the method described herein. FIG. 1 shows, in more detail, part of a printing apparatus 100 for carrying out an electrophotographic printing process. In this Figure is shown a wetting device 101, a print substrate 102, a photo imaging plate 104, binary ink development units (BIDs) 106, an intermediate transfer member (ITM) 108, charge units 110, discharging unit 112, impression roller 114, and droplets of a protic solvent 122.

In using the apparatus 100 for electrophotographic printing, a latent image may be made available for printing onto the print substrate 102. A PIP 104 is given a charge by at least one charge unit 110. The charging on the PIP forms a latent image which corresponds to an image which is to be printed by the apparatus 100. A liquid electrostatic ink composition is discharged from at least one BID 106 which adheres to the appropriately charged areas of PIP 104, thereby developing the latent image. The developed image is transferred to an ITM 108 and heated on the ITM. The developed image is transferred to a final substrate 102 as described below. PIP 104 may be discharged and cleaned by a cleaning/discharging unit 112 prior to recharging of PIP 104 in order to start another printing cycle. As substrate 102 passes by ITM 108, the image located on ITM 108 is then transferred to substrate 102. Affixation of the image to substrate 102 is facilitated by locating substrate 102 on the surface 118 of impression roller 114, which applies pressure to substrate 102 by compressing it between impression roller 114 and the surface 116 of the ITM 108 as the image is being transferred to substrate 102. Eventually, substrate 102 bearing the image exits the printer. In some examples, the printer is a sheet-fed printer. In some examples, the printer is a web-fed printer.

FIG. 1 shows a plurality of BID units 106 located adjacent the PIP 104. In some examples, each BID contains a different colored electrostatic ink composition, for use in producing multi-color images. In some examples, the BIDs may contain magenta, cyan, yellow and black ink, and may further comprise other colors, sometimes termed special colors. As described above, a one-shot process printer can transfer a multi-color image to substrate 102 in a single operation. For example, if an image to be printed is comprises four color separations, black, cyan magenta and yellow, an example mode of operation would involve charging PIP 104 with the appropriate pattern for the black toner. As PIP 104 rotates, the BID that contains black toner applies the toner onto the PIP surface 120, developing the latent image. The black toner image is then transferred to the ITM surface 116 where it remains, awaiting the deposit of the remaining color layers, cyan, magenta and yellow. While waiting, the image can be heated to a temperature in which the carrier liquid is solvated by the toner particles. This cycle repeats for each of the remaining colors until a desired multi-colored print image is located on ITM 108. Once the desired print image is assembled from the various colored toners on the ITM, it is deposited onto substrate 102.

Before the print image is transferred from the ITM to the print substrate 102, the print substrate is wetted with a protic solvent. The wetting may involve spraying a protic solvent, for example water, onto the print substrate before it reaches the ITM.

In an electrostatic printing process, certain undesired effects can arise when multi-layered images are printed using the one-shot technique, especially when more than four layers (separations) are printed. The initial toner layers deposited onto ITM 108 reside on the ITM before application of the rest of the toner layers, and before being deposited on substrate 102. This delay can causes the initial layers to lose carrier liquid, as the carrier liquid in the toner particles partially evaporates during the time of each rotation of the heated ITM 108. This loss of carrier liquid in the initial toner layers may lead to poor adhesion of the printed image to the print substrate.

In the present disclosure, the adhesion of inks has been improved by the wetting of a print substrate with a protic solvent 122. The wetting may be carried out using a wetting device 101, which may form part of the printing apparatus or may be a separate device. The wetting device 101 acts to apply a protic solvent, such as water or an alcohol, to the print substrate before an image is printed on the print substrate. In some examples, the water is applied to the same surface of the print substrate that receives the print image. The wetting device 101 may apply the water to the print image in any suitable manner, including, but not limited to, spraying the water or application using a suitable spreading member 124 such as a coating knife or a roller.

EXAMPLES

The following examples illustrate a number of variations of the methods and apparatus disclosed herein. Numerous modifications and alternative compositions and methods may be devised by those skilled in the art without departing from the spirit and scope of the methods and apparatus. The appended claims are intended to cover such modifications and arrangements.

The following test procedure was followed.

1. Prepare the tested substrate: apply water either offline (by spreading the water with wet cloth) or inline (by vapors jetting). Approx 2 μm layer of water was applied to each substrate.

2. Print the image (100% coverage with one color on entire image area) on tested substrate. The press was a HP-Indigo Press 5000 or 7000 and the inks used were HP Cyan, Magenta, Yellow and Black Electroinks, version 4.5.

3. Wait time X after print. This time X depends on substrate and may vary between 3 minutes and 1 hour for different tests.

4. For the peeling comparison: attach the adhesive tape Scotch 230 to the print substrate by pressing it with rubber coated roller having mass 1 kg. Make 5 passes with the roller over the tape.

5. Pull the tape with speed 100-200 mm/s directed opposite (180 degrees to the attached tape).

6. Repeat steps 4-5 several times at different times after print. For example, for paper "Condat" check peeling at 3 min, 5 min, 7 min, 10 min and 30 min after print; for paper "UPM Finesse" check peeling at 15 min, 30 min, 60 min, 120 min and 180 min after print.

7. Scan the tested substrate in black and white mode.

8. Edit the image in appropriate SW application (e. g. Adobe Photoshop): Set background level as white, foreground as black; select measured area, which should have part of ink missing—mixed black and white area; use "Average" filter on selected area; measure the color in the selected area; this color matches the fixing percentage because more the ink is left on paper the more black will be in the area and the higher the ink fixing.

Visual inspection of the Condat paper at various time intervals after printing (1 minute, 3 minutes and 10 minutes), when subjected to the peeling comparison, found that far less ink was removed from the Condat paper that had been pre-wetted than the same paper that had not been pre-wetted. Similarly, visual inspection of the UPM paper at various time intervals after printing (10 minute, 1 hour and 3 hours), when subjected to the peeling comparison, found that far less ink was removed from the UPM paper that had been pre-wetted than the same paper that had not been pre-wetted.

Figure 3:
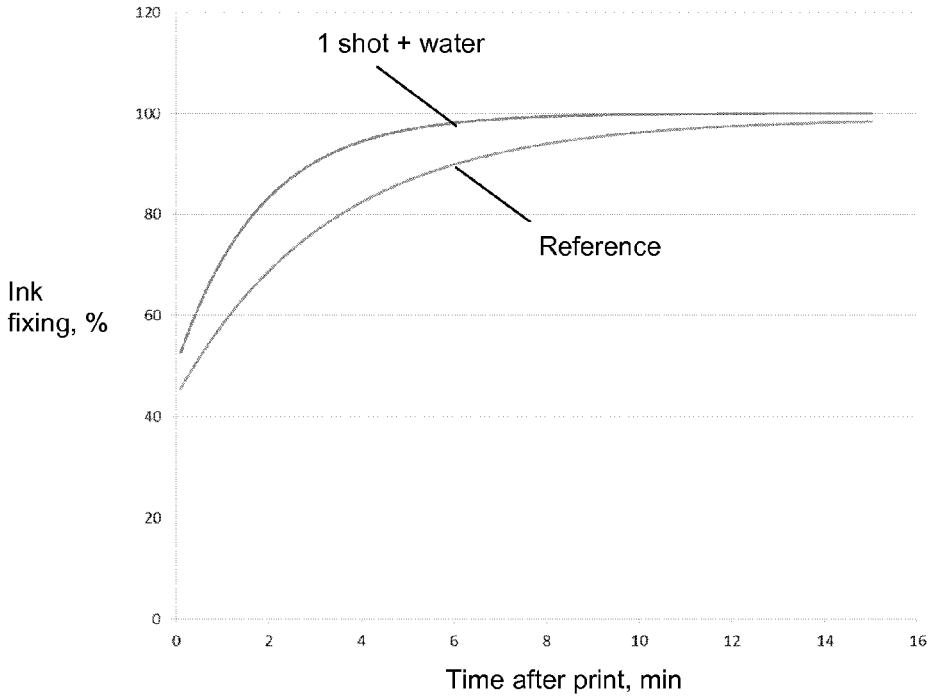
FIGS. 3 and 4 both show the ink fixing in percent vs time after print for two different types of print substrates, and the difference between a reference one-shot printing method and a method in which the print substrates have been pre-wetted with a protic solvent. The test used to obtain these results is described in more detail in the Examples below.
Figure 4:
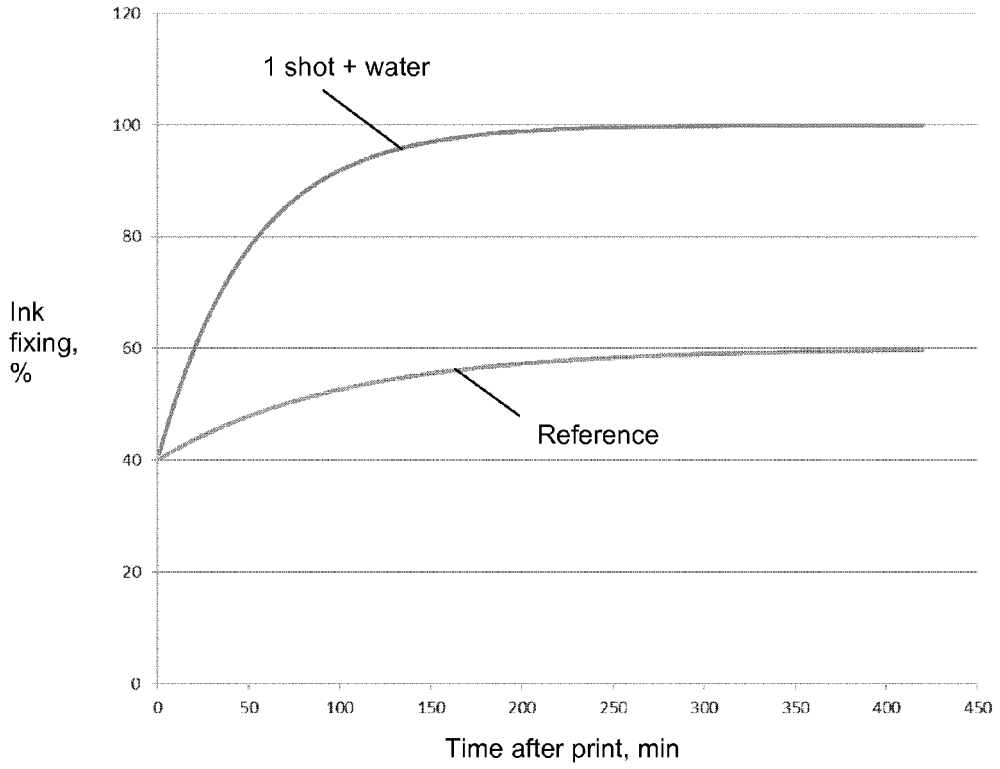

The results are illustrated in FIGS. 3 and 4. FIG. 3 shows, for Condat paper, ink fixing % vs. time after print for a reference sample (marked 'Reference'; lower line) and the same paper having been pre-wetted with water (marked '1 shot+water'), both having been printed in a one-shot method with the printer and inks mentioned above.

FIG. 4 shows, for UPM Finesse paper, ink fixing % vs. time after print for a reference sample (marked 'Reference'; lower line) and the same paper having been pre-wetted with water (marked '1 shot+water'), both having been printed in a one-shot method with the printer and inks mentioned above. It can be seen for both types of paper that, at a given time after printing, more of the ink remains adhered to the paper that is prewetted, after having been subjected to steps 4 and 5 in the test method above.

While the methods and apparatus has been described with reference to certain examples, those skilled in the art will appreciate that various modifications, changes, omissions, and substitutions can be made without departing from the spirit of the disclosure. It is intended, therefore, that the methods and apparatus be limited only by the scope of the following claims. Unless otherwise stated, the features of any dependent claim can be combined with the features of any of the other dependent claims.

The invention claimed is:

1. A method for electrophotographic printing, the method comprising:

transferring, separately, from a photo imaging plate, a plurality of images formed from different colored electrostatic ink compositions to an intermediate transfer member to form a print image on the intermediate transfer member;

providing a print substrate that has been wetted at least where the printed image is to be printed with a protic solvent selected from the group consisting of water and an alcohol; and transferring the print image to the print substrate.

2. The method according to claim 1, wherein the protic solvent consists of water.

3. The method according to claim 1, wherein the protic solvent consists of an alkanol.

4. The method according to claim 1, wherein the protic solvent is applied in an amount of from about 0.1 g to about 10 g of protic solvent per square meter of print substrate.

5. The method according to claim 1, wherein the protic solvent is applied in an amount of from about 0.1 g to about 5 g of protic solvent per square meter of print substrate.

6. The method according to claim 1, wherein the protic solvent is sprayed onto the print substrate and/or spread on a surface of the print substrate with a spreading member, to wet the print substrate with the protic solvent.

7. The method according to claim 1, wherein the protic solvent is applied to the print substrate in an even distribution across the whole area that is to receive the print image.

8. The method according to claim 1, wherein the print substrate is in the form of sheet, and a plurality of separate sheets are printed using the method.

9. The method according to claim 1, wherein the protic solvent is applied in a printing apparatus that prints the print image onto the print substrate and the apparatus includes a wetting device that applies the protic solvent to the print substrate before the print image is transferred to the print substrate.

10. The method according to claim 1, wherein the protic solvent is applied to the print substrate before it is passed into a printing apparatus that prints the print image on the print substrate.

11. An apparatus for electrophotographic printing on a print substrate, the apparatus comprising:

a photo imaging plate, an intermediate transfer member, and a wetting device for application of a protic solvent to the print substrate at least where the printed image is to be printed, the protic solvent selected from the group consisting of water and an alcohol, wherein the apparatus can form a plurality of images sequentially from different coloured electrostatic ink compositions on a photo imaging plate and transfer them separately from the photo imaging plate to the intermediate transfer member to form a print image on the intermediate transfer member and then transfer the print image to the print substrate, wherein the wetting device can apply the protic solvent to the print substrate before the print image is transferred to the print substrate.

12. The apparatus according to claim 11, wherein the wetting device can spray the protic solvent onto the print substrate and/or spread the protic solvent on a surface of the print substrate with a spreading member.

13. The apparatus according to claim 11, wherein the apparatus is configured to apply the protic solvent in an amount of from about 0.1 g to about 10 g of protic solvent per square meter of print substrate.

14. The apparatus according to claim 11, wherein the apparatus can print a plurality print substrates in the form of separate sheets.

15. The apparatus according to claim 11, wherein the protic solvent consists of water.

16. The apparatus according to claim 11, wherein the protic solvent consists of an alkanol.

* * * * *